US008240580B2

(12) United States Patent
Seki et al.

(10) Patent No.: US 8,240,580 B2
(45) Date of Patent: Aug. 14, 2012

(54) BALLAST RETAINING STRUCTURE, BEDDED TRACK

(75) Inventors: Masaki Seki, Nagoya (JP); Takashi Kachi, Nagoya (JP); Mikihito Kobayashi, Nagoya (JP); Junichi Koseki, Tokyo (JP)

(73) Assignee: Central Japan Railroad Company (JP)

( * ) Notice: Subject to any disclaimer, the term of this patent is extended or adjusted under 35 U.S.C. 154(b) by 150 days.

(21) Appl. No.: 12/597,638

(22) PCT Filed: Apr. 22, 2008

(86) PCT No.: PCT/JP2008/057774

§ 371 (c)(1),
(2), (4) Date: Apr. 12, 2010

(87) PCT Pub. No.: WO2008/136313

PCT Pub. Date: Nov. 13, 2008

(65) Prior Publication Data

US 2010/0193596 A1 Aug. 5, 2010

(30) Foreign Application Priority Data

Apr. 27, 2007 (JP) ..... 2007-118847

(51) Int. Cl.
*E01B 1/00* (2006.01)

(52) U.S. Cl. ..... 238/2

(58) Field of Classification Search ..... 238/2, 6, 238/11; 104/2, 10; 404/96; 405/16, 262, 405/284

See application file for complete search history.

(56) References Cited

U.S. PATENT DOCUMENTS

| | | | | |
|---|---|---|---|---|
| 3,656,690 | A * | 4/1972 | Hanig | 238/2 |
| 3,841,554 | A * | 10/1974 | Bennett | 238/2 |
| 4,679,731 | A * | 7/1987 | Klugar et al. | 238/2 |
| 6,672,515 | B2 * | 1/2004 | Rajaram | 238/2 |
| 2011/0155818 | A1 * | 6/2011 | Kobayashi et al. | 238/2 |

FOREIGN PATENT DOCUMENTS

| | | |
|---|---|---|
| JP | 8027701 | 1/1996 |
| JP | 8074201 | 3/1996 |
| JP | 8144206 | 6/1996 |
| JP | 8151601 | 6/1996 |
| JP | 9111704 | 4/1997 |
| JP | 9137422 | 5/1997 |

(Continued)

OTHER PUBLICATIONS

International Search Report dated May 20, 2008 issued in related International Patent Application No. PCT/JP2008/057774.

English translation of International Report on Patentability from corresponding PCT Application No. PCT/JP2008/057774 dated Dec. 3, 2009.

Japanese Office Action dated Oct. 25, 2011 issued in corresponding Japanese Patent Application No. 2007-118847 with English language translation, 6 pages.

(Continued)

*Primary Examiner* — S. Joseph Morano
*Assistant Examiner* — Zachary Kuhfuss
(74) *Attorney, Agent, or Firm* — Grossman Tucker Perreault & Pfleger PLLC

(57) ABSTRACT

A ballast retaining structure includes a first layered body constituted by a plurality of bag-like objects, each being formed in a bag shape and containing the ballast, stacked from a toe of slope to a top of slope of the track bed and disposed in the extending direction of the roadbed. The bag-like object has communication holes for communicating an inside and an outside of the bag-like object formed in at least upper and lower surfaces of the bag-like object.

12 Claims, 5 Drawing Sheets

FOREIGN PATENT DOCUMENTS

| | | |
|---|---|---|
| JP | 3040337 | 8/1997 |
| JP | 11158801 | 6/1999 |
| JP | 2000086890 | 3/2000 |
| JP | 2001271301 | 10/2001 |
| JP | 2005171679 | 6/2005 |

OTHER PUBLICATIONS

Office Action from corresponding Chinese Application No. 2008800013801.4 dated May 25, 2011. English translation attached.

* cited by examiner

APPLICATION OF BINDING FORCE
BY FASTENING REINFORCING STEEL BAR

APPLICATION OF BINDING FORCE
BY FASTENING REINFORCING STEEL BAR
(BALLAST IS PROVIDED BETWEEN SLEEPERS AND NET)

APPLICATION OF BINDING FORCE
BY INSERTING REINFORCING STEEL BAR

APPLICATION OF BINDING FORCE
BY INSERTING REINFORCING STEEL BAR
(BALLAST IS PROVIDED BETWEEN SLEEPERS AND NET)

FIG. 4A

APPLICATION OF BINDING FORCE
BY FASTENING REINFORCING STEEL BAR
(ONE LAYER OF NET IS PROVIDED ON SLEEPER SIDE)

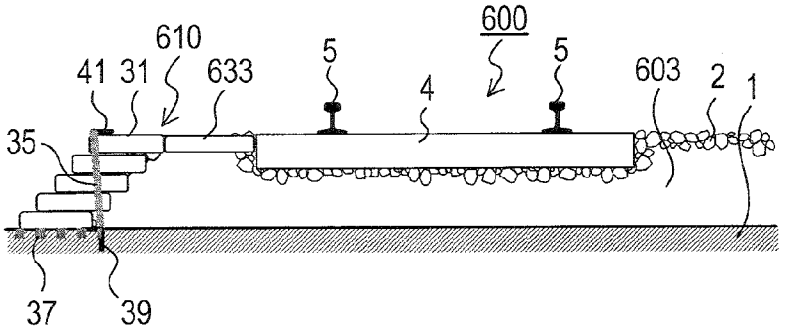

FIG. 4B

APPLICATION OF BINDING FORCE
BY FASTENING REINFORCING STEEL BAR
(NET IS NOT PROVIDED ON SLEEPER SIDE)

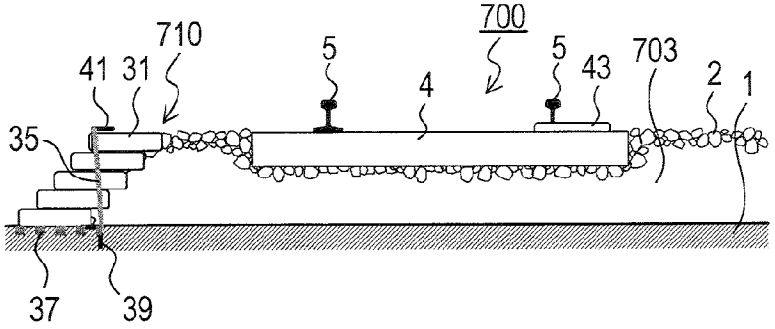

FIG. 4C

APPLICATION OF BINDING FORCE
BY INSERTING REINFORCING STEEL BAR

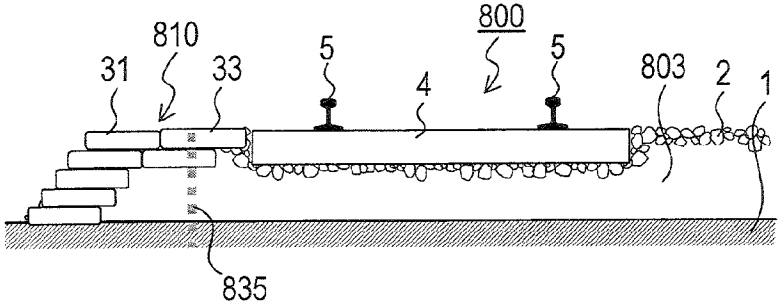

FIG. 4D

APPLICATION OF BINDING FORCE
BY INSERTING REINFORCING STEEL BAR
(BALLAST IS PROVIDED BETWEEN SLEEPERS AND NET)

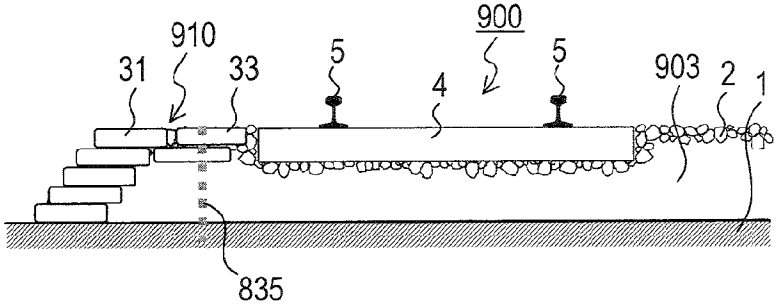

CROSS SECTION OF BALLAST

CONVENTIONAL BALLAST RETAINING STRUCTURE

BALLAST RETAINING STRUCTURE, BEDDED TRACK

TECHNICAL FIELD

The present invention relates to a bedded track in which a track bed is provided on a roadbed, and sleepers and rails are disposed on the track bed, and to a ballast retaining structure provided on both sides of the track bed of the bedded track.

BACKGROUND ART

There is a known bedded track in which a track bed is provided on a roadbed, and sleepers and rails are disposed on the track bed. Such a bedded track typically has a structure such that sleepers are disposed on the track bed formed on the roadbed, and a pair of rails are fastened to the sleepers so as to be spaced at a certain distance and parallel to each other. The track bed constituting the bedded track are made of ballast, slab, and the like, which is selected considering various conditions of each railway. A ballast bed track 1000 using ballast 2, such as gravel, crushed stones, or the like, as exemplarily shown in FIG. 5A and FIG. 5B, has been most known among them. A track bed 1003 using the ballast 2 has been employed for many years since the track bed 1003 supports running of heavy railway cars in a rational manner and is also economically competitive due to the nature thereof. The ballast 2, such as gravel, crushed stones, or the like, has functions to firmly support sleepers 4, to evenly distribute a load transmitted from a train through rails 5 and the sleepers 4 over the roadbed, and to give elasticity to a track as well as to facilitate maintenance work, such as tamping, and to give good drainage of the track thereby to prevent mud-pumping or weed incidence.

However, in the track bed using the ballast as described above, individual gravel particles or crushed stones tend to move in a vicinity of a surface of the track bed. The track bed is easily deformed due to passing train loads, a bulging force resulting from a rail axial force at a high temperature, stress by an earthquake or the like, or subsidence of an embankment structure, and thereby a height deviation of the track is sometimes caused. Accordingly, when such a height deviation of the track is caused, correction is made by refilling the ballast or tamping the track bed. Such an operation to correct the height deviation of the track requires considerable work and cost.

There is also a known track bed using ballast (see, for example, Patent Document 1) in which rigid plates are provided between a plurality of sleepers on the ballast and the rigid plates are mutually connected by upwardly U-shaped anchors passing through under the sleepers. However, in an area from a toe of slope to a top of slope of the track bed, individual gravel particles or crushed stones tend to move in a vicinity of a surface of the track bed as described above, and the track bed is easily deformed due to passing train loads, a bulging force resulting from a rail axial force at a high temperature, stress by an earthquake or the like, or subsidence of an embankment structure, and a height deviation of the track is sometimes caused.

Therefore, as illustrated by an example in FIG. 5C and FIG. 5D, there has been devised a ballast bed track 1100 (see, for example, Patent Document 2) in which ballast retaining structures 1010 are provided on both sides of a track bed 1103 on a roadbed 1 so that the ballast retaining structures 1010 can suppress deformation of a ballast 2. The ballast retaining structures 1010 which are made of concrete, such as prestressed concrete, are formed in a wall shape.

However, the above-described ballast retaining structure 1010 per unit which is formed in a wall shape with, for example, a width of 50 cm weighs approximately 200 kg. This leads to problems in construction work as follows: (1) It is required to transport the ballast retaining structures by a maintenance car or the like from a storage area to a construction cite at the time of construction. (2) It is required to use heavy equipment for construction. (3) In a case where the ballast retaining structure 1010 has a projection 1010*a*, it is required to bury the projection 1010*a* in the roadbed 1 and thus it is required to widely dig the track bed in a cross-sectional direction perpendicular to rails and backfill the track bed after disposing the ballast retaining structure 1010. Also, it is known that a construction method using the ballast retaining structure 1010 generally results in higher costs.

Then, there has been devised a method in which flexible cloth or polyethylene sandbags filled with a filling material, such as gravel or crushed stones, are disposed on a roadbed, surfaces of the sandbags are covered with crushed stones or the like to form a flat plane, sleepers are disposed on the flat plane, and rails are fastened to the sleepers (see, for example, Patent Documents 3-6). According to the method using sandbags filled with a filling material, subsidence of the rails due to repeated loads by passing railway cars can be reduced and thereby maintenance work for the rails and the track bed can be reduced, and also vibration and noise during the passing of the railway cars can be reduced, compared with the conventional method of simply laying gravel or crushed stones.

Patent Document 1: Japanese Unexamined Patent Application Publication No. 9-111704

Patent Document 2: Japanese Unexamined Patent Application Publication No. 8-144206

Patent Document 3: Japanese Unexamined Patent Application Publication No. 8-151601

Patent Document 4: Japanese Unexamined Patent Application Publication No. 8-74201

Patent Document 5: Japanese Unexamined Patent Application Publication No. 2000-86890

Patent Document 6: Japanese Unexamined Patent Application Publication No. 2001-271301

Patent Document 7: Japanese Unexamined Patent Application Publication No. 8-27701

Patent Document 8: Japanese Unexamined Patent Application Publication No. 9-137422

DISCLOSURE OF THE INVENTION

Problems to be Solved by the Invention

However, the above-described method using sandbags filled with a filling material involves a problem that, while stress increase may be expected due to dilatancy of the sandbags, the material of the sandbags between ballast particles impedes engagement between the ballast particles at a boundary between the sandbags and thereby a sufficient friction cannot be obtained, and resulting slip between the sandbags may lead to deformation of the track bed.

A method may be devised in which a honeycomb reinforcing material is disposed on a roadbed, and ballast is filled into spaces in the reinforcing material from above to form a track bed (see, for example, Patent Document 7). However, the method involves a problem that the ballast located above the honeycomb reinforcing material may collapse, leading to deformation of a surface area of the track bed.

Also, a method may be devised in which a band-like body is attached to each of upper and lower surfaces of each sandbag, and sandbags are connected by being bound by a linear member, such as a rope, inserted through band-like bodies (see, for example, Patent Document 8). However, the problem remains unsolved that the material of the sandbags between ballast particles impedes engagement between the ballast particles at a boundary between sandbags and thereby a sufficient friction cannot be obtained, and the problem remains that resulting slip between the sandbags may lead to deformation of the track bed. Further, when the sandbags are stacked up, the band-like bodies located between the sandbags impede close contact between the sandbags, and resulting slip between the sandbags may lead to deformation of the track bed.

A method may be devised in which a chemical agent, such as resin, having a high adherence is sprayed on surfaces of ballast particles or between ballast particles, to thereby secure the ballast and thus suppress displacement thereof. However, since the above-described chemical agent, such as resin, is subject to outflow due to rain and degradation due to change over time, the above effect by the chemical agent is not permanent. Accordingly, the chemical agent needs to be sprayed repeatedly at short intervals, and such spraying requires considerable labor and time.

The present invention, which has been made in view of these problems, has an object to provide a technique which does not require heavy equipment and can suppress deformation of a track bed of a bedded track while achieving a good constructability and lower costs.

Means for Solving the Problems

A ballast retaining structure (110: Although symbols used in the section "Best Mode for Carrying Out the Invention" are assigned in this section when necessary, for easy understanding of the invention, it does not mean that the claims are limited by the symbols.) in a first aspect of the present invention made to solve the aforementioned problems is used for a bedded track (100) provided with a track bed (3) formed by laying ballast (2) on a roadbed (1), performing tamping to form a bed-like structure having a predetermined cross-sectional shape such as a trapezoid, and extending the bed-like structure in an extending direction of the roadbed; a plurality of sleepers (4) disposed on the track bed such that longitudinal directions of the sleepers are perpendicular to an extending direction of the track bed; and a pair of rails (5) fastened to upper surfaces of the plurality of sleepers along the extending direction of the track bed, the ballast retaining structure being provided on both sides in a transverse direction of the track bed and along the extending direction of the track bed to thereby retain the track bed from the both sides in the transverse direction thereof. The ballast retaining structure includes: a first layered body (31) constituted by a plurality of bag-like objects (32), each being formed in a bag shape and containing ballast, stacked from a toe of slope to a top of slope of the track bed and disposed in the extending direction of the roadbed, and the bag-like object has communication holes (32*a*) for communicating an inside and an outside of the bag-like object formed in at least upper and lower surfaces of the bag-like object.

The communication holes of the bag-like object may have a size preventing the ballast particles from passing therethrough. For example, the communication hole may be formed to have a diameter of approximately ½-¼ of an average particle diameter of the ballast.

According to the ballast retaining structure of the present invention configured as above, the ballast particles contained in the bag-like object are not separated one another, and the ballast particles partially project from the communication holes. Then, the ballast particles partially projecting from the communication holes of vertically adjacent bag-like objects mutually engage, and thereby the bag-like objects are less likely to be mutually displaced in a transverse direction of the track bed. Thus, the ballast retaining structure is less likely to be deformed, and the track bed is less likely to be deformed. Accordingly, compared with conventional configurations, no heavy equipment is required, and deformation of the track bed of the bedded track can be suppressed while a good constructability and lower costs can be achieved.

In this case, the bag-like object may have a plurality of communication holes formed in at least upper and lower surfaces of the bag-like object (a second aspect of the present invention). According to such a configuration, ballast particles partially projecting from the communication holes of the bag-like objects are increased, and the number of mutually engaging ballast particles is increased. Then, the vertically adjacent bag-like objects are less likely to be displaced in a transverse direction of the track bed, and thereby the ballast retaining structure is less likely to be deformed, and thus the track bed is less likely to be deformed.

The plurality of communication holes may be unevenly arranged in the upper and lower surfaces of the bag-like object.

Alternatively, the plurality of communication holes may be evenly arranged in the upper and lower surfaces of the bag-like object. Examples of evenly arranging the plurality of communication holes are a case wherein at least upper and lower surfaces of the bag-like object have mesh-like configurations, a case wherein at least upper and lower surfaces of the bag-like object have net-like configurations (a third aspect of the present invention), and a case wherein at least upper and lower surfaces of the bag-like object have grid-like configurations.

According to the configurations described above, ballast particles partially projecting from the communication holes of the bag-like objects are increased, and the number of mutually engaging ballast particles is increased. Then, the vertically adjacent bag-like objects are less likely to be displaced in a transverse direction of the track bed, and thereby the ballast retaining structure is less likely to be deformed, and thus the track bed 3 is less likely to be deformed.

Also, at least upper and lower surfaces of the bag-like object may be made of net as in a fourth aspect of the present invention. According to such a configuration, the following operation and effects (1)-(7) can be obtained.

(1) By using a net having a larger mesh size filled with ballast and roller compacting the net with a compactor or the like, friction caused by engagement of ballast particles is increased.

(2) Also, the net filled with ballast has a manually conveyable weight, and requires no large construction equipment, such as heavy equipment, owing to a smaller excavation cross-section. Accordingly, constructability can be improved, and a greater construction length per night can be achieved.

(3) Further, even if a depression or subsidence of the roadbed occurs due to heavy rain or the like, the net moves in its entirety and therefore a depression of the ballast will not occur. Thus, safe running of trains can be secured.

(4) Since the ballast in the net does not flow out, extra bag-like objects, if placed on the track bed or elsewhere, can be utilized as stockpiled ballast to be, for example, scattered to an area in which ballast has flown out.

(5) Since the ballast in the net does not move, fluidization of ballast occurring in a canted section or the like can be suppressed.

(6) Use of a net or the like leading to a lower material cost and no need of large heavy equipment for construction results in reduced construction costs.

(7) Since the track bed with the bag-like objects can have a greater gradient, a wider maintenance path can be secured.

Further, it may be possible to insert a connection member, such as a bar, through mutually opposing communication holes of the bag-like objects constituting the first layered body, in order to suppress deformation of the ballast retaining structure in the transverse direction of the track bed. Specifically, as in a fifth aspect of the present invention, one of the communication holes formed in the upper or lower surface of the bag-like object may be arranged so as to oppose one of communication holes of a bag-like object adjacent to the bag-like object, and the ballast retaining structure may include a first connection member (35) which has a bar-like shape, is passed through mutually opposing communication holes among the communication holes of the plurality of bag-like objects to be located inside the first layered body with a leading end of the first connection member being buried into the roadbed, and thereby connects with each other the plurality of bag-like objects constituting the first layered body.

According to this configuration, since the first connection member inserted through the mutually opposing communication holes formed in the bag-like objects constituting the first layered body is located inside the first layered body, the first connection member connects adjacent bag-like objects; and since the leading end of the first connection member is buried in the roadbed, the bag-like objects connected by the first connection member is less likely to be displaced in the transverse direction of the track bed, and thus the ballast remaining structure is less likely to be deformed against a force acting in the transverse direction of the track bed. That is, by applying a prestress (a binding force) to the first layered body by the first connection member, an improved shear stress of the first layered body can be obtained, and thereby deformation of the track bed can be suppressed even when an impulsive stress is applied to the track bed, for example, at a high temperature or during an earthquake. Thus, safe running of trains can be secured.

In this case, the first connection member may have an upper lock portion (41) to downwardly press an upper surface of the first layered body in a vicinity of an upper end of the first connection member (a sixth aspect of the present invention). According to this configuration, by the upper lock portion downwardly pressing the upper surface of the first layered body, the ballast particles, partially projecting from the communication holes of the vertically adjacent bag-like objects, engage one another further firmly, and the vertically adjacent bag-like objects are far less likely to be displaced in the transverse direction of the track bed. Then, the ballast retaining structure is far less likely to be deformed, and thus the track bed is far less likely to be deformed.

Also, the first connection member may have a lower lock portion (39) to upwardly press a lower surface of the first layered body in a vicinity of a lower end of the first connection member (a seventh aspect of the present invention). According to this configuration, by the lower lock portion upwardly pressing the lower surface of the first layered body, the upper lock portion and the lower lock portion cooperatively press the first layered body from above and below, and the ballast particles, partially projecting from the communication holes of the vertically adjacent bag-like objects, engage one another further firmly, and the vertically adjacent bag-like objects are far less likely to be displaced in the transverse direction of the track bed. Then, the ballast retaining structure is far less likely to be deformed, and thus the track bed is far less likely to be deformed.

Incidentally, in the track bed, ballast is laid in an area between the first layered body and sleepers, and when the area where ballast is laid has a large width, there is caused a problem that the area is likely to be deformed since ballast particles are not mutually bound.

Therefore, a second layered body which is different from the above-described first layered body may be provided between the first layered body and the sleepers. Specifically, as in an eighth aspect of the present invention, a configuration may be devised such that a second layered body (33), which is constituted by bag-like objects (34), each being formed in a bag shape and containing ballast, placed between the first layered body and the sleepers and extended in the extending direction of the roadbed, is provided, and the bag-like object has communication holes (**34*a***) for communicating an inside and an outside of the bag-like object formed in at least upper and lower surfaces of the bag-like object.

The communication holes in the bag-like objects may have sizes preventing the ballast from passing therethrough. For example, the communication holes in the bag-like objects may be formed to have diameters approximately ½-¼ of an average particle diameter of the ballast.

According to this configuration, ballast particles contained in the bag-like object constituting the second layered body are not separated one another also in the area between the first layered body in the track bed and the sleepers, and the ballast particles partially project from the communication holes. Then, the ballast particles, partially projecting from the communication holes, engage with other ballast particles. Then, the bag-like objects are less likely to be displaced in a transverse direction of the track bed, and thereby the ballast retaining structure is less likely to be deformed, and thus the track bed is less likely to be deformed. Accordingly, compared with conventional configurations, no heavy equipment is required, and deformation of the track bed of the bedded track can be suppressed while a good constructability and lower costs can be achieved.

In this case, the second layered body to be provided between the first layered body and the sleepers may be disposed so as to contact both of the first layered body and the sleepers, in order to reduce, in the track bed, a width of the ballast laid between the first layered body and the sleepers (a ninth aspect of the present invention). According to this configuration, there is no area where the ballast is laid between the first layered body and the sleepers. Accordingly, the ballast retaining structure is less likely to be deformed, and thus the track bed is less likely to be deformed. Also, the sleepers are sandwiched between the ballast retaining structures provided on both sides of the track bed, and thus rightward or leftward deviation of the sleepers caused by train loads can be suppressed.

In this case, the bag-like object constituting the second layered body may have a plurality of the communication holes formed in at least upper and lower surfaces of the bag-like object (a tenth aspect of the present invention). According to this configuration, ballast particles partially projecting from the communication holes of the bag-like objects are increased, and the number of mutually engaging ballast particles is increased. Then, the bag-like objects vertically adjacent are far less likely to be mutually displaced in a transverse direction of the track bed, and thereby the ballast retaining structure is far less likely to be deformed, and thus the track bed is far less likely to be deformed.

The plurality of the above-described communication holes may be unevenly arranged in the upper and lower surfaces of the bag-like object constituting the second layered body.

The plurality of the above-described communication holes may be evenly arranged in the upper and lower surfaces of the bag-like object constituting the second layered body. Examples of evenly arranging the plurality of communication holes are a case wherein at least upper and lower surfaces of the bag-like object have mesh-like configurations, a case wherein at least upper and lower surfaces of the bag-like object have net-like configurations (an eleventh aspect of the present invention), and a case wherein at least upper and lower surfaces of the bag-like object have grid-like configurations.

According to this configuration, ballast particles partially projecting from the communication holes of the bag-like objects constituting the second layered body are increased, and the number of mutually engaging ballast particles is increased. Then, the vertically adjacent bag-like objects are far less likely to be displaced in a transverse direction of the track bed, and thereby the ballast retaining structure is far less likely to be deformed, and thus the track bed is far less likely to be deformed.

In addition, as in a twelfth aspect of the present invention, at least upper and lower surfaces of the bag-like object constituting the second layered body may be made of net. According to this configuration, the aforementioned operations and effects (1)-(7) can be obtained.

Further, a second connection member, such as a bar, may be inserted through mutually opposing communication holes of the bag-like objects constituting the second layered body, in order to suppress deformation of the ballast retaining structure in the transverse direction of the track bed. Specifically, as in a thirteenth aspect of the present invention, the second layered body is constituted by a plurality of the bag-like objects, each containing ballast, placed between the first layered body and the sleepers and extended in the extending direction of the roadbed, one of the communication holes formed in the upper or lower surface of the bag-like object constituting the second layered body is arranged so as to oppose one of the communication holes formed in the upper or lower surface of a bag-like object adjacent to the bag-like object, and there is provided a second connection member (835) which has a bar-like shape, is passed through mutually opposing communication holes among the communication holes of the plurality of bag-like objects to be located inside the second layered body with a leading end of the second connection member being buried into the roadbed, and thereby connects with each other the plurality of bag-like objects constituting the second layered body.

According to this configuration, the second connection member inserted through mutually opposing communication holes formed in the bag-like objects constituting the second layered body is located inside the second layered body, the second connection member connects adjacent bag-like objects with each other, and a leading end of the second connection member is buried into the roadbed. As a result, the bag-like objects mutually connected by the second connection member are less likely to be displaced in the transverse direction of the track bed, and thereby the ballast retaining structure is less likely to be displaced. That is, by applying a prestress (a binding force) to the second layered body by the second connection member, an improved shear stress of the second layered body can be obtained, and thereby deformation of the track bed can be suppressed even when an impulsive stress is applied to the track bed, for example, at a high temperature or during an earthquake. Thus, safe running of trains can be secured.

Moreover, the present invention may be achieved as a bedded track. Specifically, a bedded track in a fourteenth aspect of the present invention, which has been made to solve the above-described problems, is a bedded track including a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and a pair of rails fastened to upper surfaces of the plurality of sleepers along the extending direction of the track bed, wherein part of the track bed is constituted by the ballast retaining structure according to one of the first aspect of the present invention to the thirteenth aspect of the present invention.

BRIEF DESCRIPTION OF THE DRAWINGS

FIG. 4A is a cross-sectional view showing a configuration of a bedded track 600 in a sixth embodiment, FIG. 4B is a cross-sectional view showing a configuration of a bedded track 700 in a seventh embodiment, FIG. 4C is a cross-sectional view showing a configuration of a bedded track 800 in a eighth embodiment, and FIG. 4D is a cross-sectional view showing a configuration of a bedded track 900 in a ninth embodiment.

FIG. 5A is a cross-sectional view showing a configuration of ballast, FIG. 5B is a cross-sectional view showing a configuration of a conventional bedded track, FIG. 5C is a cross-sectional view showing a configuration of a conventional ballast retaining structure, and FIG. 5D is a cross-sectional view showing a configuration of a conventional bedded track including the conventional ballast retaining structure.

EXPLANATION OF REFERENCE NUMERALS

1 . . . roadbed; 2 . . . ballast; 3, 203, 303, 403, 503, 603, 703, 803, 903, 1003, 1103 . . . track bed; 4 . . . sleeper; 5 . . . rail; 31, 33, 633 . . . layered body; 32, 34, 43 . . . bag-like object; 32*a*, 34*a* . . . communication hole; 35, 835 . . . reinforcing steel bar; 35*a* . . . leading end; 35*b* . . . central portion; 35*c* . . . rear end; 37 . . . metal net; 39, 41 . . . L-shaped angle member; 100, 200, 300, 400, 500, 600, 700, 800, 900 . . . bedded track; 110, 210,

310, 410, 510, 610, 710, 810, 910, 1010 . . . ballast retaining structure; 1000, 1100 . . . ballast bed track; 1010*a* . . . projecting portion

BEST MODE FOR CARRYING OUT THE INVENTION

Hereinafter, embodiments of the present invention will be described with reference to the drawings.

[First Embodiment]

Figure 1A:
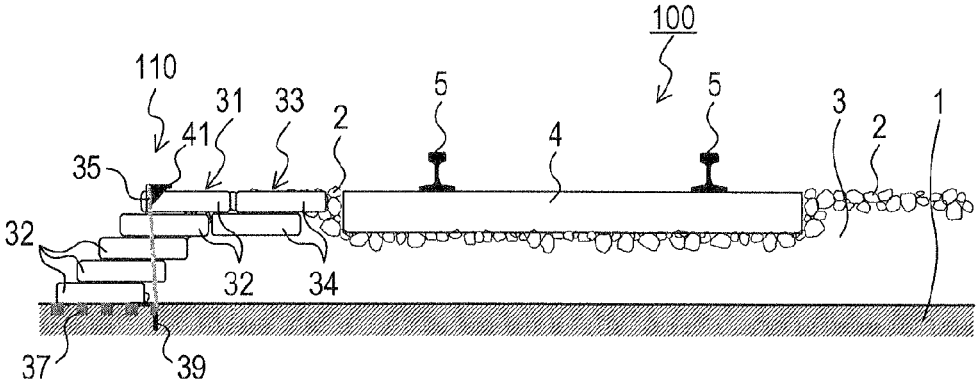
FIG. 1A is a front cross-sectional view showing a configuration of a bedded track 100 in a first embodiment.
Figure 1B:
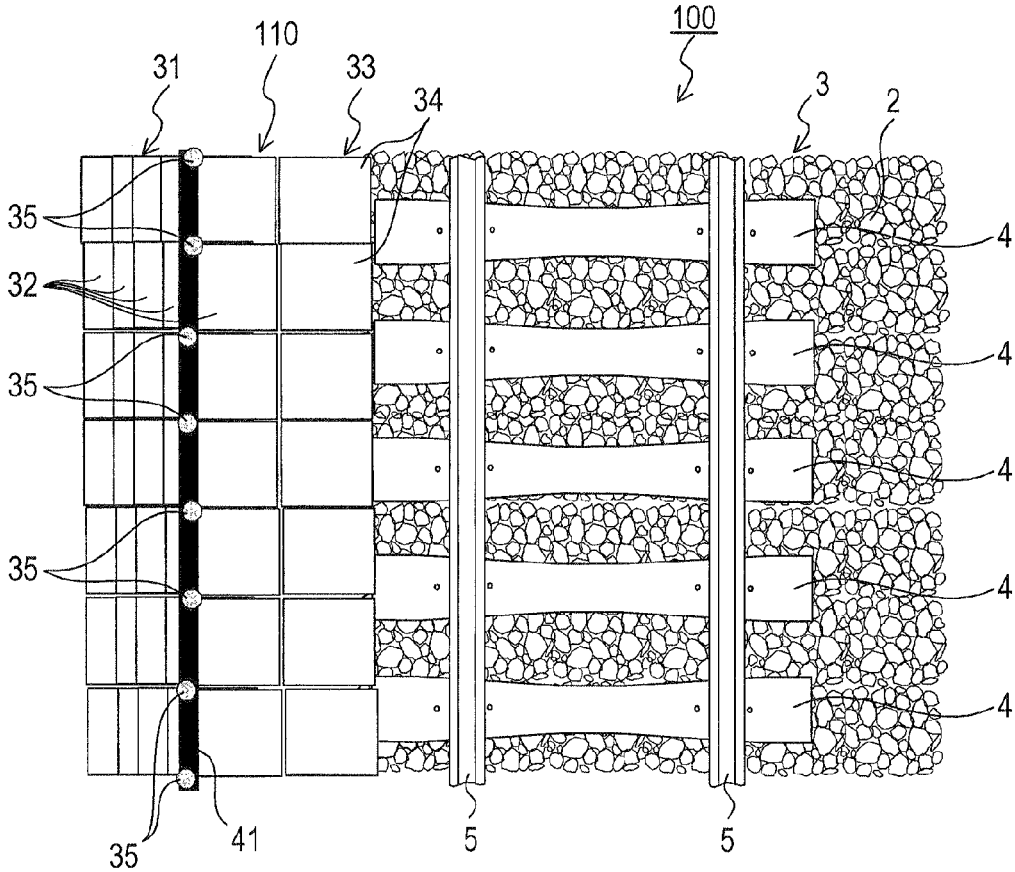
FIG. 1B is a plan view of the bedded track 100 in the first embodiment.

FIG. 1A is a front cross-sectional view showing a configuration of a bedded track 100 in the present embodiment. FIG. 1B is a plan view of the bedded track 100 in the present embodiment, FIG. 2A is a cross-sectional view showing a configuration of a ballast retaining structure 110 in the present invention, and FIG. 2B is an explanatory view showing a configuration of a bag-like object 32 made of net formed in a bag shape.

[Explanation of Configuration of Bedded Track 100]

Figure 2A:
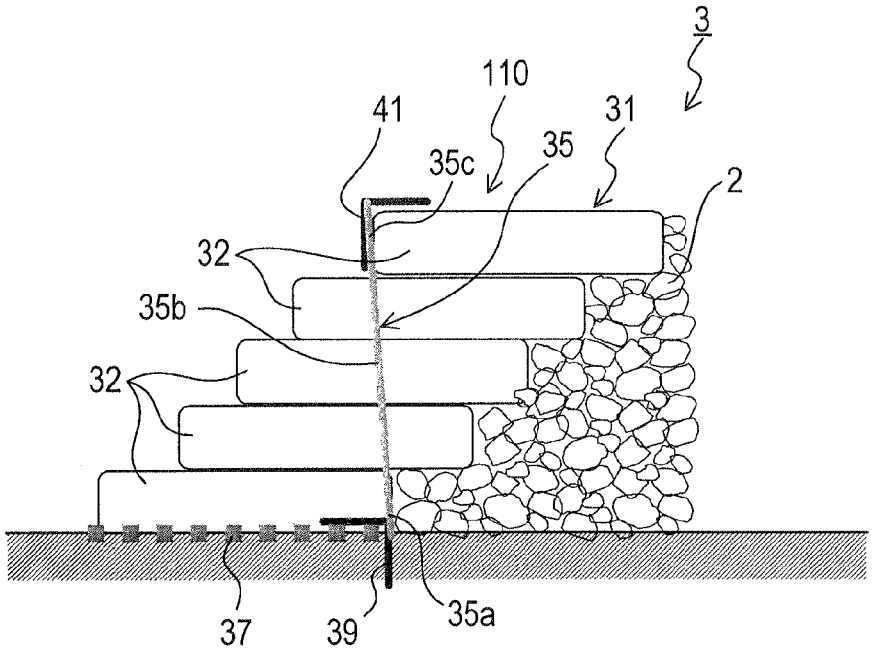
FIG. 2A is a cross-sectional view showing a configuration of a layered body 31 of a ballast retaining structure 110 in the first embodiment.
Figure 2B:
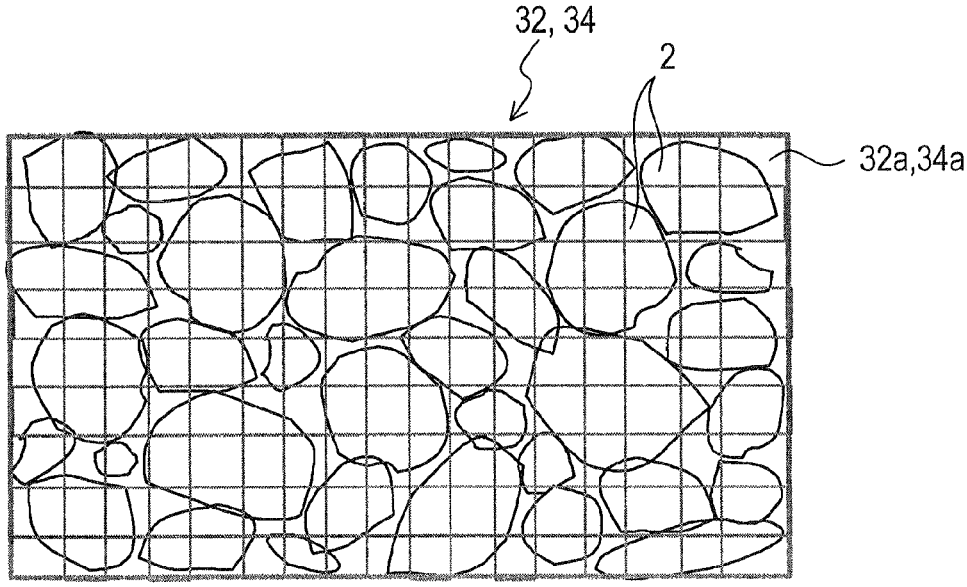
FIG. 2B is an explanatory view showing a configuration of a bag-like object 32 made of net formed in a bag shape.

As shown in FIG. 1A, FIG. 1B and FIG. 2A, the bedded track 10 includes a track bed 3, formed by laying ballast 2, such as crushed stones, on a roadbed 1, tamping the ballast 2 so as to form a bed-like structure having a predetermined cross-sectional shape, such as a trapezoid, and extending the bed-like structure in an extending direction of the bedded track 100; a plurality of sleepers 4 (only one sleeper 4 is shown in FIG. 1A) disposed on the track bed 3 such that a longitudinal direction of each sleeper is perpendicular to an extending direction of the track bed 3; and a pair of rails 5 fastened to upper surfaces of the plurality of sleepers 4 along the extending direction of the track bed 3.

[Explanation of Configuration of Track Bed 3]

As described above, the track bed 3 is formed by laying ballast 2, such as crushed stones, on the roadbed 1, tamping the ballast 2 so as to form the bed-like structure having the predetermined cross-sectional shape, such as a trapezoid, and extending the bed-like structure in the extending direction of the bedded track 100. Also, the track bed 3 includes a layered body 31, which is disposed from a toe of slope to a top of slope of the track bed 3, a layered body 33 disposed between the layered body 31 and the sleepers 4, a reinforcing steel bar 35, a metal net 37, an L-shaped angle member 39, and an L-shaped angle member 41.

In the present embodiment, the layered body 31, the layered body 33, the reinforcing steel bar 35, the metal net 37, the L-shaped angle member 39, and the L-shaped angle member 41 constitute the ballast retaining structure 110.

Among these, the layered body 31 has a structure such that a plurality of bag-like objects 32, each made of net formed in a bag shape and containing the ballast 2, are stacked in upper and lower directions from the toe of slope to the top of slope of the track bed 3, and are also extendingly disposed in an extending direction of the bedded track 100. The layered body 31 is disposed on the metal net 37 laid on the roadbed 1. Also, the layered body 31 is roller compacted by a compactor. The bag-like object 32 is made of net formed in a bag shape, and thus has a lot of communication holes 32*a* for communicating an inside and an outside of the bag-like object 32, as shown in FIG. 2B. In FIG. 2B, however, a reference numeral is assigned to only one communication hole 32*a* in order to avoid complication in the figure. The communication holes 32*a* of the bag-like object 32 are formed to have a size preventing the ballast 2 from passing therethrough. In the present embodiment, a net having a mesh of approximately ½-¼ of an average particle diameter of the ballast 2 is used for forming the bag-like object 32. Accordingly, one of the communication holes 32*a* of the bag-like object 32 constituting the layered body 31 is arranged so as to oppose one of communication holes 32*a* of a vertically adjacent bag-like object 32, and allows insertion therethrough of a later-mentioned reinforcing steel bar 35.

The layered body 33 has a structure such that a plurality of bag-like objects 34, each made of net formed in a bag shape and containing the ballast 2, are stacked in upper and lower directions between the layered body 31 of the track bed 3 and the sleepers 4, and are also extendingly disposed in an extending direction of the bedded track 100. The layered body 33 is disposed on the ballast 2 laid on the roadbed 1. Also, the layered body 33 is roller compacted by a compactor. The layered body 33 is disposed so as to contact the layered body 31, and the ballast 2 is laid between the layered body 33 and the sleepers 4. The bag-like object 34 is made of net formed in a bag shape, and thus has a lot of communication holes 34*a* for communicating an inside and an outside of the bag-like object 34, in a same manner as the bag-like object 32. In FIG. 2B, however, a reference numeral is assigned to only one communication hole 34*a* in order to avoid complication in the figure in a same manner as the case of the bag-like object 32. The communication holes 34*a* of the bag-like object 34 are formed to have a size preventing the ballast 2 from passing therethrough. In the present embodiment, a net having a mesh of approximately ½-¼ of an average particle diameter of the ballast 2 is used for forming the bag-like object 34. Accordingly, one of the communication holes 34*a* of the bag-like object 34 constituting the layered body 33 is arranged so as to oppose one of communication holes 34*a* of a vertically adjacent bag-like object 32, and allows insertion therethrough of the later-mentioned reinforcing steel bar 35.

The reinforcing steel bar 35, which is constituted by a steel rod, is inserted through the layered body 31 from an upper side to a lower side. Specifically, the reinforcing steel bar 35 is inserted from a communication hole 32*a* in an upper surface of the layered body 31 to an inside with a leading end 35*a* of the reinforcing steel bar 35 located at the head, passed through mutually opposing communication holes 32*a* of the bag-like objects 32, and then the leading end 35*a* is buried into the roadbed 1 under the layered body 31 while a central portion 35*b* is located inside the layered body 31. Consequently, the reinforcing steel bar 35 connects with each other the plurality of bag-like objects 32 constituting the layered body 31.

The L-shaped angle member 39 is attached to the leading end 35*a* of the reinforcing steel bar 35 so as to be movable in upper and lower directions. The L-shaped angle member 39 is abutted to an inner corner of the bag-like object 32 provided at a lowest position among the bag-like objects 32 constituting the layered body 31, and has a not-shown through hole in which the leading end 35*a* of the reinforcing steel bar 35 is inserted. A not-shown nut is attached to a threaded portion which is formed at the leading end 35*a* of the reinforcing steel bar 35. By rotating the nut, the L-shaped angle member 39 can be moved in upper and lower directions.

Also, the L-shaped angle member 41 is attached to the rear end 35*c* of the reinforcing steel bar 35 so as to be movable in upper and lower directions. The L-shaped angle member 41 is abutted to an outer corner of the bag-like object 32 provided uppermost among the bag-like objects 32 constituting the layered body 31, and has a not-shown through hole in which the rear end 35*c* of the reinforcing steel bar 35 is inserted. A not-shown nut is attached to a threaded portion which is formed at the rear end 35*c* of the reinforcing steel bar 35. By rotating the nut, the L-shaped angle member 41 can be moved in upper and lower directions.

By rotating the nut attached to the leading end 35*a* of the reinforcing steel bar 35 and the nut attached to the rear end 35*c* of the reinforcing steel bar 35, the L-shaped angle member 39 upwardly presses a lower surface of the layered body 31 while the L-shaped angle member 41 downwardly presses the upper surface of the layered body 31. Thus, the reinforcing steel bar 35, the L-shaped angle member 39, and the L-shaped angle member 41 cooperatively press the layered body 31 from above and below.

The layered body 31 corresponds to a first layered body. The layered body 33 corresponds to a second layered body. The reinforcing steel bar 35 corresponds to a first connection member. The L-shaped angle member 39 corresponds to a lower lock portion, while the L-shaped angle member 41 corresponds to an upper lock portion.

[Effects of First Embodiment]

(1) According to the bedded track 100 in the first embodiment as above, the layered body 31 in the ballast retaining structure 110 has a structure such that the bag-like objects 32, each made of net formed in a bag shape and containing the ballast 2, are stacked from the toe of slope to the top of slope of the track bed 3, and are also extendingly disposed in the extending direction of the bedded track 100. Since the bag-like object 32 is made of net formed in a bag shape, a lot of communication holes 32*a* for communicating the inside and the outside of the bag-like object 32 are formed. In the present embodiment, a net having a mesh of approximately ½-¼ of an average particle diameter of the ballast 2 is used for forming the bag-like object 32.

As a result, particles of the ballast 2 contained in the bag-like object 32 are not separated one another, and the particles of the ballast 2 partially project from the communication holes 32*a*, and then the particles of the ballast 2, partially projecting from the communication holes 32*a* of vertically adjacent bag-like objects 32, mutually engage. Then, the bag-like objects 32 are less likely to be mutually displaced in a transverse direction of the track bed 3, and thereby the ballast retaining structure 110 is less likely to be deformed, and thus the track bed 3 is less likely to be deformed.

Specifically, use of net for the bag-like objects 32 prevents deterioration of frictional force by mutual engagement of the ballast 2, roller compaction provides tension to the bag-like objects 32 thereby to bind the ballast 2 contained in the bag-like objects 32, the reinforcing steel bar 35 improves shear strength of the layered body 31, and thereby suppress deformation of the ballast 2 in case a stress is applied. Accordingly, compared with conventional configurations, no heavy equipment is required, an improved constructability may be achieved, and deformation of the track bed 3 of the bedded track 100 may be suppressed.

(2) Also, according to the bedded track 100 in the first embodiment, a net having a mesh of approximately ½-¼ of an average particle diameter of the ballast 2 is used for forming the bag-like object 32, and a lot of communication holes 32*a* for communicating the inside and the outside of the bag-like object 32 are formed. As a result, particles of the ballast 2 partially projecting from the communication holes 32*a* of the bag-like objects 32 are increased, and the number of mutually engaging particles of the ballast 2 is increased. Then, the bag-like objects 32 vertically adjacent are far less likely to be displaced in a transverse direction of the track bed 3, and thereby the ballast retaining structure 110 is less likely to be deformed, and thus the track bed 3 is less likely to be deformed.

(3) Further, according to the bedded track 100 in the first embodiment, each of the bag-like objects 32 and the bag-like objects 34 is constituted by a net having a mesh of approximately ½-¼ of an average particle diameter of the ballast 2. This leads to the following operation and effects.

(3-1) By using the bag-like object 32 of net containing the ballast 2 and roller compacting the bag-like object 32 by a compactor or the like, friction by engagement of ballast particles is increased.

(3-2) Also, the bag-like object 32 of net, even containing the ballast 2, has a weight such that the bag-like object 32 can be manually conveyed, and no large construction equipment, such as heavy equipment, is needed since an excavation cross-section is small. Accordingly, constructability can be improved, and a greater construction length per night can be achieved.

(3-3) Further, even if a depression or subsidence of the roadbed occurs due to heavy rain or the like, the bag-like object 32 of net moves in its entirety and therefore a depression of the ballast 2 will not occur. Thus, safe running of trains can be secured.

(3-4) Since the ballast 2 in the bag-like object 32 of net does not flow out, extra bag-like objects 32, if placed on the track bed 3 or elsewhere, can be utilized as stockpiled ballast to be, for example, scattered to an area in which ballast has flown out.

(3-5) Since the ballast 2 in the bag-like object 32 of net does not move, fluidization of the ballast 2 occurring in a canted section or the like can be suppressed.

(3-6) Use of the bag-like objects 32 of net leads to a lower material cost, and no need of large heavy equipment for construction leads to a reduced construction cost.

(3-7) Since the track bed 3 may have a greater gradient by using the bag-like objects 32 of net, a wider maintenance path may be secured.

(4) Also, according to the bedded track 100 in the first embodiment, the reinforcing steel bar 35 in the ballast retaining structure 110 is constituted by a steel rod, inserted from a communication hole 32*a* in the upper surface of the layered body 31 to the inside with the leading end 35*a* of the reinforcing steel bar 35 located at the head, passed through mutually opposing communication holes 32*a* of the bag-like objects 32, and then the leading end 35*a* is buried into the roadbed 1 under the layered body 31 while a central portion 35*b* is located inside the layered body 31. Consequently, the reinforcing steel bar 35 connects with each other the plurality of bag-like objects 32 constituting the layered body 31, while the leading end 35*a* thereof is buried into the roadbed 1, and the bag-like objects 32 connected with each other by the reinforcing steel bar 35 are less likely to be displaced in the transverse direction of the track bed 3, and thereby the ballast retaining structure 110 is less likely to be deformed. That is, by applying a prestress (a binding force) to the layered body 31 by the reinforcing steel bar 35, an improved shear stress of the layered body 31 may be obtained, and thereby deformation of the track bed 3 can be suppressed even when an impulsive stress is applied to the track bed 3, for example, at a high temperature or during an earthquake. Thus, safe running of trains can be secured.

(5) Further, according to the bedded track 100 in the first embodiment, by rotating the nut attached to the leading end 35*a* of the reinforcing steel bar 35 and the nut attached to the rear end 35*c* of the reinforcing steel bar 35, the L-shaped angle member 39 upwardly presses the lower surface of the layered body 31 while the L-shaped angle member 41 downwardly presses the upper surface of the layered body 31, and thus the reinforcing steel bar 35, the L-shaped angle member 39, and the L-shaped angle member 41 cooperatively press the layered body 31 from above and below. Consequently, particles of the ballast 2 partially projecting from the communication holes 32*a* of the bag-like objects 32 mutually engage one another further firmly, and the vertically adjacent bag-like objects 32 are far less likely to be displaced in the transverse direction of the track bed 3. Then, the ballast retaining structure 110 is far less likely to be deformed, and thus the track bed 3 is far less likely to be deformed.

(6) Furthermore, according to the bedded track 100 in the first embodiment, the layered body 33 in the ballast retaining structure 110 has a structure such that the bag-like objects 34, each made of net formed in a bag shape and containing the ballast 2, are stacked between the layered body 31 of the track bed 3 and the sleepers 4, and are also extendingly disposed in the extending direction of the bedded track 100. The bag-like object 34 is made of net formed in a bag shape, and thus has a lot of communication holes 34*a* for communicating the inside and the outside of the bag-like object 34. In the present embodiment, the net having a mesh of approximately ½-¼ of an average particle diameter of the ballast 2 is used for forming the bag-like object 34.

Consequently, particles of the ballast 2 contained in the bag-like object 34 are not separated one another also in an area between the layered body 31 in the track bed 3 and the sleepers 4, and the particles of the ballast 2 partially project from the communication holes 34*a*. Then the particles of the ballast 2, partially projecting from the communication holes 34*a* of vertically adjacent bag-like objects 34, mutually engage, and the bag-like objects 34 are further less likely to be mutually displaced in the transverse direction of the track bed 3, and thereby the ballast retaining structure 110 is further less likely to be deformed, and thus the track bed 3 is further less likely to be deformed. Accordingly, compared with conventional configurations, no heavy equipment is required, an improved constructability may be achieved, and deformation of the track bed 3 of the bedded track 100 may be suppressed at a reduced cost.

(7) Also, according to the bedded track 100 in the first embodiment, the bag-like object 34 is made of net formed in a bag shape and thus has a lot of communication holes 34*a* for communicating the inside and the outside of the bag-like object 34. As a result, particles of the ballast 2 partially projecting from the communication holes 34*a* of the bag-like objects 34 are increased, and the number of mutually engaging particles of the ballast 2 is increased. Then, the vertically adjacent bag-like objects 34 are far less likely to be displaced in a transverse direction of the track bed 3, and thereby the ballast retaining structure 110 is far less likely to be deformed, and thus the track bed 3 is far less likely to be deformed.

[Second Embodiment]

In the first embodiment described above, the layered body 33 to be provided between the layered body 31 and the sleepers 4 is disposed so as to contact the layered body 31, and the ballast 2 is laid between the layered body 33 and the sleepers 4. In contrast, a second embodiment shown in FIG. 3A has a feature that the layered body 33 to be provided between the layered body 31 and the sleepers 4 is disposed so as to contact both of the layered body 31 and the sleepers 4, in order to reduce, in a track bed 203, a width of the ballast 2 laid between the layered body 31 and the sleepers 4.

A configuration of a bedded track 200 in the second embodiment will be described hereinafter. Note that FIG. 3A is a cross-sectional view showing the configuration of the bedded track 200 in the second embodiment.

Since the second embodiment has a lot of components in common with the first embodiment, the same reference numerals as in the first embodiment are used and detailed descriptions thereof are omitted herein.

[Explanation of Configuration of Track Bed 203]

Figure 3A:
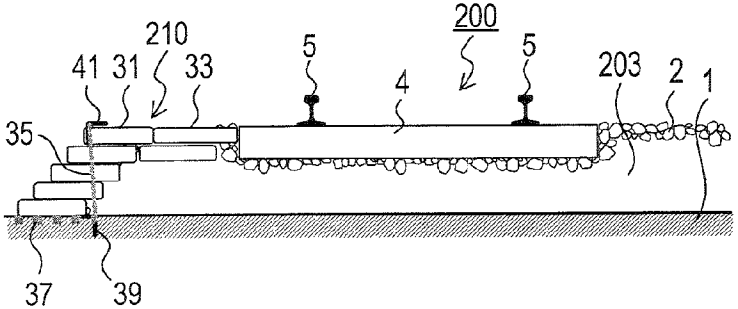
FIG. 3A is a cross-sectional view showing a configuration of a bedded track 200 in a second embodiment.

As shown in FIG. 3A, the track bed 203 of the bedded track 200 includes the layered body 31, the layered body 33, the reinforcing steel bar 35, the metal net 37, the L-shaped angle member 39, and the L-shaped angle member 41, and the layered body 33 among these is disposed so as to contact both of the layered body 31 and the sleepers 4.

In the present embodiment, the layered body 31, the layered body 33, the reinforcing steel bar 35, the metal net 37, the L-shaped angle member 39, and the L-shaped angle member 41 constitute a ballast retaining structure 210.

[Effects of Second Embodiment]

According to the bedded track 200 in the second embodiment, the layered body 33 is disposed so as to contact both of the layered body 31 and the sleepers 4 in the ballast retaining structure 210, and thereby there is almost no area where the ballast 2 is laid between the layered body 31 and the sleepers 4. Accordingly, the ballast retaining structure 210 is less likely to be deformed, and thus the track bed 203 is less likely to be deformed. Also, the sleepers 4 are sandwiched between the ballast retaining structures 210 provided on both sides of the track bed 203, and thus rightward or leftward deviation of the sleepers 4 caused by train loads can be suppressed.

[Third Embodiment]

In the first embodiment described above, the plurality of sleepers 4 are disposed on the track bed 3 such that the longitudinal direction of each sleeper is perpendicular to the extending direction of the track bed 3; and a pair of rails 5 fastened to upper surfaces of the plurality of sleepers 4 along the extending direction of the track bed 3. In contrast, a third embodiment shown in FIG. 3B has a feature that a bag-like object 43 is provided between mutually adjacent sleepers 4.

A configuration of a bedded track 300 in the third embodiment will be described hereinafter. Note that FIG. 3B is a cross-sectional view showing the configuration of the bedded track 300 in the third embodiment.

Since the third embodiment has a lot of components in common with the first embodiment, the same reference numerals as in the first embodiment are used and detailed descriptions thereof are omitted herein.

[Explanation of Configuration of Track Bed 303]

Figure 3B:
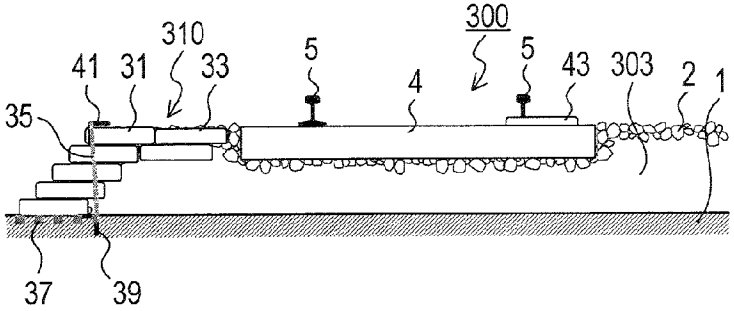
FIG. 3B is a cross-sectional view showing a configuration of a bedded track 300 in a third embodiment.

As shown in FIG. 3B, the track bed 303 of the bedded track 300 includes the layered body 31, the layered body 33, the reinforcing steel bar 35, the metal net 37, the L-shaped angle member 39, the L-shaped angle member 41, and the bag-like object 43.

In the present embodiment, the layered body 31, the layered body 33, the reinforcing steel bar 35, the metal net 37, the L-shaped angle member 39, the L-shaped angle member 41, and the bag-like object 43 constitute a ballast retaining structure 310.

In a same manner as the bag-like object 32, the bag-like object 43 is made of net formed in a bag shape, and has a lot of communication holes formed therein for communicating the inside and the outside of the bag-like object 43. Each of the communication holes of the bag-like object 43 is formed to have a size to prevent any particle of the ballast 2 from passing therethrough. In the present embodiment, a net having a mesh of approximately ½-¼ of an average particle diameter of the ballast 2 is used for forming the bag-like object 43. The communication holes are net holes like 32*a* and 34*a* shown in FIG. 2B, and not shown in a figure.

The bag-like object 43 is provided between a sleeper 4 and a sleeper 4.

[Effects of Third Embodiment]

(1) According to the bedded track 300 in the third embodiment as above, the bag-like object 43 is disposed between the sleepers 4. Accordingly, a distance between the sleepers 4 is less likely to change, and thus forward or rearward displacement of the sleepers 4 caused by train loads can be suppressed.

(2) Also, since the ballast 2 in the bag-like object 43 of net does not flow out, extra bag-like objects 43, if placed on the track bed 303 or elsewhere, can be utilized as stockpiled ballast to be, for example, scattered to an area in which ballast has flown out.

[Fourth Embodiment]

In the first embodiment described above, the reinforcing steel bar 35 is inserted through the layered body 31 from the upper side to the lower side, and the L-shaped angle member 39 is attached to the leading end 35*a* of the reinforcing steel bar 35 so as to be movable in the upper and lower directions, while the L-shaped angle member 41 is attached to the rear end 35*c* of the reinforcing steel bar 35 so as to be movable in the upper and lower directions. Also, the layered body 33 provided between the layered body 31 and the sleepers 4 is disposed so as to contact the layered body 31, and the ballast 2 is laid between the layered body 33 and the sleepers 4. In contrast, a fourth embodiment shown in FIG. 3C has the following features: The L-shaped angle member 39 positioned on a lower side in the first embodiment is not provided, the reinforcing steel bar 35 is inserted through the layered body 31 from the upper side to the lower side, and the L-shaped angle member 41 is attached to the rear end 35*c* of the reinforcing steel bar 35 so as to be movable in the upper and lower direction. In addition, the layered body 33 provided between the layered body 31 and the sleepers 4 is disposed so as to contact both of the layered body 31 and the sleepers 4, in order to reduce a width of the ballast 2 laid between the layered body 31 and the sleepers 4.

A configuration of a bedded track 400 in the fourth embodiment will be described hereinafter. Note that FIG. 3C is a cross-sectional view showing the configuration of the bedded track 400 in the fourth embodiment.

Since the fourth embodiment has a lot of components in common with the first embodiment, the same reference numerals as in the first embodiment are used and detailed descriptions thereof are omitted herein.

[Explanation of Configuration of Track Bed 403]

Figure 3C:
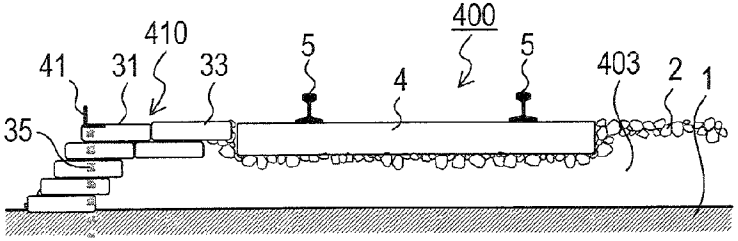
FIG. 3C is a cross-sectional view showing a configuration of a bedded track 400 in a fourth embodiment.

As shown in FIG. 3C, the track bed 403 of the bedded track 400 includes the layered body 31, the layered body 33, the reinforcing steel bar 35, and the L-shaped angle member 41. The track bed 403 does not include the L-shaped angle member 39 as the track bed 3 in the first embodiment. Also, the layered body 33 is disposed so as to contact both of the layered body 31 and the sleepers 4.

In the present embodiment, the layered body 31, the layered body 33, the reinforcing steel bar 35, and the L-shaped angle member 41 constitute a ballast retaining structure 410.

By rotating the nut attached to the rear end 35*c* of the reinforcing steel bar 35, the L-shaped angle member 41 downwardly presses the upper surface of the layered body 31.

[Effects of Fourth Embodiment]

(1) According to the bedded track 400 in the fourth embodiment as above, in the ballast retaining structure 410, the reinforcing steel bar 35 is inserted through the layered body 31 from the upper side to the lower side, and the L-shaped angle member 41 is attached to the rear end 35*c* of the reinforcing steel bar 35 so as to be movable in the upper and lower directions, and by rotating the nut attached to the rear end 35*c* of the reinforcing steel bar 35, the L-shaped angle member 41 downwardly presses the upper surface of the layered body 31. Accordingly, the bag-like objects 32 connected by the reinforcing steel bar 35 are less likely to be mutually displaced in a transverse direction of the track bed 403, and the ballast retaining structure 410 is less likely to be deformed against a force acting in the transverse direction of the track bed 403. That is, by applying a prestress (a binding force) to the layered body 31 by the reinforcing steel bar 35, an improved shear stress of the layered body 31 can be obtained, and thereby deformation of the track bed 403 can be suppressed even when an impulsive stress is applied to the track bed 403, for example, at a high temperature or during an earthquake. Thus, safe running of trains can be secured.

(2) Further, according to the bedded track 400 in the fourth embodiment, the layered body 33 is disposed so as to contact both of the layered body 31 and the sleepers 4, and thereby there is no area where the ballast 2 is laid between the layered body 31 and the sleepers 4. Accordingly, the ballast retaining structure 410 is less likely to be deformed, and thus the track bed 403 is less likely to be deformed. Also, the sleepers 4 are sandwiched between the ballast retaining structures 410 provided on both sides of the track bed 403, and thus rightward or leftward deviation of the sleepers 4 caused by train loads can be suppressed.

[Fifth Embodiment]

In the first embodiment described above, the reinforcing steel bar 35 is inserted through the layered body 31 from the upper side to the lower side, and the L-shaped angle member 39 is attached to the leading end 35*a* of the reinforcing steel bar 35 so as to be movable in the upper and lower directions, while the L-shaped angle member 41 is attached to the rear end 35*c* of the reinforcing steel bar 35 so as to be movable in the upper and lower direction. Also, the layered body 33 provided between the layered body 31 and the sleepers 4 is disposed so as to contact the layered body 31, and the ballast 2 is laid between the layered body 33 and the sleepers 4. In contrast, a fifth embodiment shown in FIG. 3D has the following features: The L-shaped angle member 39 positioned on a lower side in the first embodiment is not provided, the reinforcing steel bar 35 is inserted through the layered body 31 from the upper side to the lower side, and the L-shaped angle member 41 is attached to the rear end 35*c* of the reinforcing steel bar 35 so as to be movable in the upper and lower directions.

A configuration of a bedded track 500 in the fifth embodiment will be described hereinafter. Note that FIG. 3D is a cross-sectional view showing the configuration of the bedded track 500 in the fifth embodiment.

Since the fifth embodiment has a lot of components in common with the first embodiment, the same reference numerals as in the first embodiment are used and detailed descriptions thereof are omitted herein.

[Explanation of Configuration of Track Bed 503]

Figure 3D:
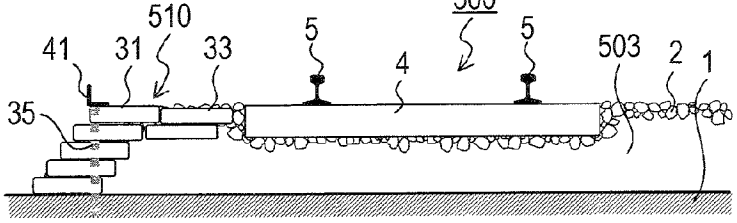
FIG. 3D is a cross-sectional view showing a configuration of a bedded track 500 in a fifth embodiment.
Figure 5A:
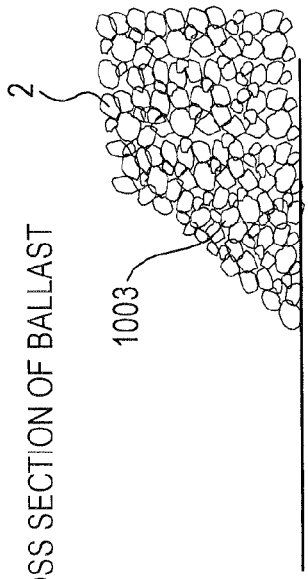
FIGS. 5A-5D are cross-sectional views showing configurations of conventional bedded tracks.
Figure 5B:
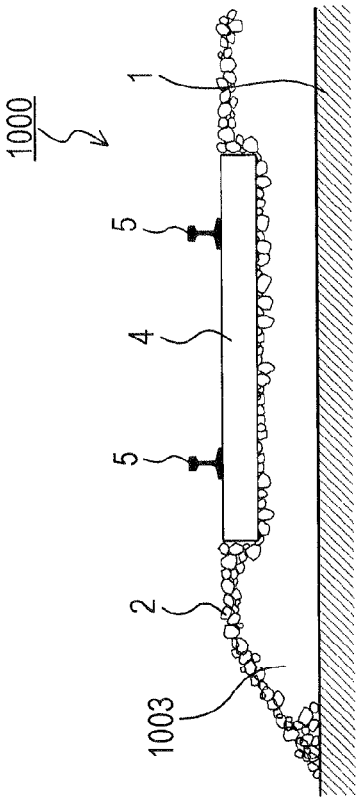
Figure 5C:
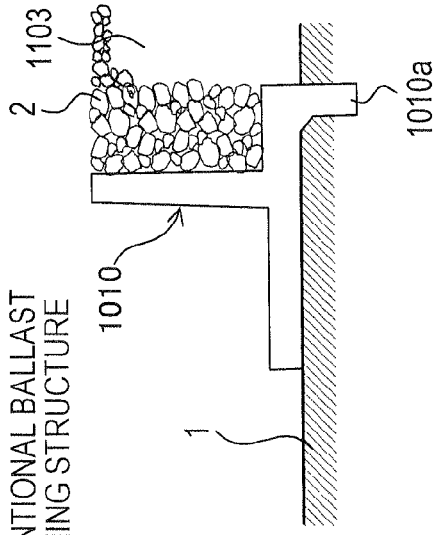
Figure 5D:
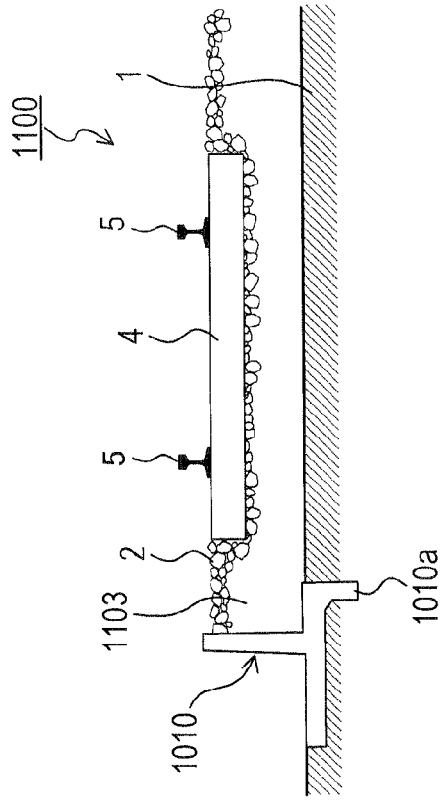

As shown in FIG. 3D, the track bed 503 of the bedded track 500 includes the layered body 31, the layered body 33, the reinforcing steel bar 35, and the L-shaped angle member 41. The track bed 503 does not include the L-shaped angle member 39 as the track bed 3 in the first embodiment.

In the present embodiment, the layered body 31, the layered body 33, the reinforcing steel bar 35, and the L-shaped angle member 41 constitute a ballast retaining structure 510.

By rotating the nut attached to the rear end 35*c* of the reinforcing steel bar 35, the L-shaped angle member 41 downwardly presses the upper surface of the layered body 31.

[Effects of Fifth Embodiment]

According to the bedded track 500 in the fifth embodiment, in the ballast retaining structure 510, the reinforcing steel bar 35 is inserted through the layered body 31 from the upper side to the lower side, and the L-shaped angle member 41 is attached to the rear end 35*c* of the reinforcing steel bar 35 so as to be movable in the upper and lower directions, and by rotating the nut attached to the rear end 35*c* of the reinforcing steel bar 35, the L-shaped angle member 41 downwardly presses the upper surface of the layered body 31. Accordingly, the bag-like objects 32 connected by the reinforcing steel bar 35 are less likely to be mutually displaced in a transverse direction of the track bed 503, and the ballast retaining structure 510 is less likely to be deformed against a force acting in the transverse direction of the track bed 503. That is, by applying a prestress (a binding force) to the layered body 31 by the reinforcing steel bar 35, an improved shear stress of the layered body 31 can be obtained, and thereby deformation of the track bed 503 can be suppressed even when an impulsive stress is applied to the track bed 503, for example, at a high temperature or during an earthquake. Thus, safe running of trains can be secured.

[Sixth Embodiment]

In the first embodiment described above, the layered body 33 in the ballast retaining structure 110 has a structure such that a plurality of bag-like objects 34, each made of net formed in a bag shape and containing the ballast 2, are stacked in upper and lower directions between the layered body 31 of the track bed 3 and the sleepers 4, and are also extendingly disposed in an extending direction of the bedded track 100. Also, the layered body 33 provided between the layered body 31 and the sleepers 4 is disposed so as to contact the layered body 31, and the ballast 2 is laid between the layered body 33 and the sleepers 4. In contrast, a sixth embodiment shown in FIG. 4A has the following features: A layered body 633 of a ballast retaining structure 610 is configured such that one bag-like object 34, made of net formed in a bag shape and containing the ballast 2, is placed between the layered body 31 of the track bed 603 and the sleepers 4, and also bag-like objects 34 are extendingly disposed in an extending direction of the track bed 603. Also, the layered body 633 to be provided between the layered body 31 and the sleepers 4 is disposed so as to contact both of the layered body 31 and the sleepers 4, in order to reduce a width of the ballast 2 laid between the layered body 31 and the sleepers 4.

A configuration of a bedded track 600 in the sixth embodiment will be described hereinafter. Note that FIG. 4A is a cross-sectional view showing the configuration of the bedded track 600 in the sixth embodiment.

Since the sixth embodiment has a lot of components in common with the first embodiment, the same reference numerals as in the first embodiment are used and detailed descriptions thereof are omitted herein.

[Explanation of Configuration of Track Bed 603]

As shown in FIG. 4A, the track bed 603 of the bedded track 600 includes the layered body 31, the layered body 633, the reinforcing steel bar 35, the metal net 37, the L-shaped angle member 39, and the L-shaped angle member 41.

In the present embodiment, the layered body 31, the layered body 633, the reinforcing steel bar 35, the metal net 37, the L-shaped angle member 39, and the L-shaped angle member 41 constitute a ballast retaining structure 610.

The layered body 633 is configured such that one bag-like object 34, made of net formed in a bag shape and containing the ballast 2, is placed between the layered body 31 of the track bed 603 and the sleepers 4, and also bag-like objects 34 are extendingly disposed in an extending direction of the bedded track 600. The layered body 633 is provided on the ballast 2 laid on the roadbed 1. Note that the layered body 633 is disposed so as to contact both of the layered body 31 and the sleepers 4 4t.

[Effects of Sixth Embodiment]

(1) According to the bedded track 600 in the sixth embodiment as above, the layered body 633 in the ballast retaining structure 610 is configured such that one bag-like object 34, made of net formed in a bag shape and containing the ballast 2, is placed between the layered body 31 of the track bed 603 and the sleepers 4, and also bag-like objects 34 are extendedly disposed in an extending direction of the track bed 603. The bag-like object 34 is made of net formed in a bag shape, and thus has a lot of communication holes 34*a* for communicating the inside and the outside of the bag-like object 34.

Consequently, particles of the ballast 2 contained in the bag-like object 34 are not separated one another also in an area between the layered body 31 in the track bed 603 and the sleepers 4, and the particles of the ballast 2 partially project from the communication holes 34*a*. Then, the particles of the ballast 2 partially projecting from the communication holes 34*a* of vertically adjacent bag-like objects 34 mutually engage, and the bag-like objects 34 are less likely to be mutually displaced in a transverse direction of the track bed 603, and thereby the ballast retaining structure 610 is further less likely to be deformed, and thus the track bed 603 is further less likely to be deformed. Accordingly, compared with conventional configurations, no heavy equipment is required, and deformation of the track bed of the bedded track can be suppressed while a good constructability and lower costs can be achieved.

(2) According to the bedded track 600 in the sixth embodiment, the layered body 633 is disposed so as to contact both of the layered body 31 and the sleepers 4, and thereby there is no area where the ballast 2 is laid between the layered body 31 and the sleepers 4. Accordingly, the ballast retaining structure 610 is less likely to be deformed, and thus the track bed 603 is less likely to be deformed. Also, the sleepers 4 are sandwiched between the ballast retaining structures 610 provided on both sides of the track bed 603, and thus rightward or leftward deviation of the sleepers caused by train loads can be suppressed.

[Seventh Embodiment]

In the first embodiment described above, the layered body 33 in the ballast retaining structure 110 is configured such that a plurality of bag-like objects 34, each made of net formed in a bag shape and containing the ballast 2, are stacked in the upper and lower directions between the layered body 31 of the track bed 3 and the sleepers 4, and are also extendingly disposed in the extending direction of the bedded track 100. In contrast, a seventh embodiment shown in FIG. 4B has a feature that the layered body 33 is not provided between the layered body 31 of a track bed 703 and the sleepers 4, the ballast 2 is provided between the layered body 31 and the sleepers 4, and the bag-like object 43 is provided between adjacent sleepers 4.

A configuration of a bedded track 700 in the seventh embodiment will be described hereinafter. Note that FIG. 4B is a cross-sectional view showing the configuration of the bedded track 700 in the seventh embodiment.

Since the sixth embodiment has a lot of components in common with the first embodiment, the same reference numerals as in the first embodiment are used and detailed descriptions thereof are omitted herein.

[Explanation of Configuration of Track Bed 703]

As shown in FIG. 4B, the track bed 703 of the bedded track 700 includes the layered body 31, the reinforcing steel bar 35, the metal net 37, the L-shaped angle member 39, the L-shaped angle member 41, and the bag-like object 43. The ballast 2 is provided between the layered body 31 of the track bed 703 and the sleepers 4.

In the present embodiment, the layered body 31, the reinforcing steel bar 35, the metal net 37, the L-shaped angle member 39, the L-shaped angle member 41, and the bag-like object 43 constitute a ballast retaining structure 710.

In a same manner as the bag-like object 32, the bag-like object 43 is made of net formed in a bag shape, and has a lot of communication holes formed therein for communicating the inside and the outside of the bag-like object 43. Each of the communication holes in the bag-like object 43 is formed to have a size to prevent any particle of the ballast 2 from passing therethrough. In the present embodiment, a net having a mesh of approximately ½-¼ of an average particle diameter of the ballast 2 is used for forming the bag-like object 43. Also, the bag-like object 43 is provided between adjacent sleepers 4.

[Effects of Seventh Embodiment]

(1) According to the bedded track 700 in the seventh embodiment as above, the same effects as the above-described effects (1)-(5) of the first embodiment can be obtained.

(2) Also, according to the bedded track 700 in the seventh embodiment, the bag-like object 43 is disposed between the adjacent sleepers 4. Accordingly, a distance between the adjacent sleepers 4 is less likely to change, and thus forward or rearward deviation of the sleepers 4 caused by train loads can be suppressed.

(3) Further, since the ballast 2 in the bag-like object 43 of net does not flow out, extra bag-like objects 43, if placed on the track bed 703 or elsewhere, can be utilized as stockpiled ballast to be, for example, scattered to an area in which ballast has flown out.

[Eighth Embodiment]

In the first embodiment described above, the reinforcing steel bar 35 is inserted through the layered body 31 from the upper side to the lower side, and the L-shaped angle member 39 is attached to the leading end 35*a* of the reinforcing steel bar 35 so as to be movable in the upper and lower directions, while the L-shaped angle member 41 is attached to the rear end 35*c* of the reinforcing steel bar 35 so as to be movable in the upper and lower directions. In contrast, a eighth embodiment shown in FIG. 4C has the following features: The reinforcing steel bar 35, the L-shaped angle member 39, or the L-shaped angle member 41 as in the first embodiment is not provided, and the reinforcing steel bar 835 is inserted through the layered body 31 from the upper side to the lower side. In addition, the layered body 33 to be provided between the layered body 31 and the sleepers 4 is disposed so as to contact both of the layered body 31 and the sleepers 4, in order to reduce a width of the ballast 2 laid between the layered body 31 and the sleepers 4.

A configuration of a bedded track 800 in the eighth embodiment will be described hereinafter. Note that FIG. 4C is a cross-sectional view showing the configuration of the bedded track 800 in the eighth embodiment.

Since the eighth embodiment has a lot of components in common with the first embodiment, the same reference numerals as in the first embodiment are used and detailed descriptions thereof are omitted herein.

[Explanation of Configuration of Track Bed 803]

As shown in FIG. 4C, the track bed 803 of the bedded track 800 includes the layered body 31, the layered body 33, the reinforcing steel bar 835. The layered body 33 is disposed so as to contact both of the layered body 31 and the sleepers 4.

In the present embodiment, the layered body 31, the layered body 33, the reinforcing steel bar 835 constitute a ballast retaining structure 810.

The reinforcing steel bar 835, which is constituted by a steel rod in the same manner as the reinforcing steel bar 35, is inserted through the layered body 33. Specifically, the reinforcing steel bar 835 is inserted from a communication hole 34*a* in an upper surface of the layered body 33 to an inside with a leading end of the reinforcing steel bar 835 located at the head and passed through mutually opposing communication holes 34*a* of the bag-like objects 34, and then the leading end is buried into the roadbed 1 under the layered body 33 while a central portion thereof is located inside the layered body 33.

The reinforcing steel bar 835 corresponds to a second connection member.

[Effects of Eighth Embodiment]

(1) According to the bedded track 800 in the eighth embodiment as above, the reinforcing steel bar 835 is inserted through the layered body 33 from the upper side to the lower side. Accordingly, the bag-like objects 34 connected by the reinforcing steel bar 835 are less likely to be mutually displaced in a transverse direction of the track bed 803, and the ballast retaining structure 810 is less likely to be deformed against a force acting in the transverse direction of the track bed 803. That is, by applying a prestress (a binding force) to the layered body 33 by the reinforcing steel bar 835, an improved shear stress of the layered body 33 can be obtained, and thereby deformation of the track bed 803 can be suppressed even when an impulsive stress is applied to the track bed 803, for example, at a high temperature or during an earthquake. Thus, safe running of trains can be secured.

(2) Further, according to the bedded track 800 in the eighth embodiment, the layered body 33 is disposed so as to contact both of the layered body 31 and the sleepers 4, and thereby there is no area where the ballast 2 is laid between the layered body 31 and the sleepers 4. Accordingly, the ballast retaining structure 810 is less likely to be deformed, and thus the track bed 803 is less likely to be deformed. Also, the sleepers 4 are sandwiched between the ballast retaining structures 810 provided on both sides of the track bed 803, and thus rightward or leftward deviation of the sleepers 4 caused by train loads can be suppressed.

[Ninth Embodiment]

In the first embodiment described above, the reinforcing steel bar 35 is inserted through the layered body 31 from the upper side to the lower side, and the L-shaped angle member 39 is attached to the leading end 35*a* of the reinforcing steel bar 35 so as to be movable in the upper and lower directions, while the L-shaped angle member 41 is attached to the rear end 35*c* of the reinforcing steel bar 35 so as to be movable in the upper and lower directions.

In contrast, a ninth embodiment shown in FIG. 4D has the following features: The reinforcing steel bar 35, the L-shaped angle member 39, or the L-shaped angle member 41 as in the first embodiment is not provided, and the reinforcing steel bar 835 is inserted through the layered body 33 from the upper side to the lower side.

A configuration of a bedded track 900 in the ninth embodiment will be described hereinafter. Note that FIG. 4D is a cross-sectional view showing the configuration of the bedded track 900 in the ninth embodiment.

Since the ninth embodiment has a lot of components in common with the first embodiment, the same reference numerals as in the first embodiment are used and detailed descriptions thereof are omitted herein.

[Explanation of Configuration of Track Bed 903]

As shown in FIG. 4D, the track bed 903 of the bedded track 900 includes the layered body 31, the layered body 33, the reinforcing steel bar 835. The layered body 33 is disposed so as to contact the layered body 31, and the ballast 2 is laid between the layered body 33 and the sleepers 4.

In the present embodiment, the layered body 31, the layered body 33, the reinforcing steel bar 835 constitute a ballast retaining structure 910.

[Effects of Ninth Embodiment]

According to the bedded track 900 of the ninth embodiment, the reinforcing steel bar 835 of the ballast retaining structure 910 is inserted through the layered body 33 from the upper side to the lower side. Accordingly, the bag-like objects 34 connected by the reinforcing steel bar 835 are less likely to be mutually displaced in a transverse direction of the track bed 903, and the ballast retaining structure 910 is less likely to be deformed against a force acting in the transverse direction of the track bed 903. That is, by applying a prestress (a binding force) to the layered body 33 by the reinforcing steel bar 835, an improved shear stress of the layered body 33 can be obtained, and thereby deformation of the track bed 903 can be suppressed even when an impulsive stress is applied to the track bed 903, for example, at a high temperature or during an earthquake. Thus, safe running of trains can be secured.

[Other Embodiments]

Although embodiments of the present invention have been described as above, the present invention should not be limited to the above-described embodiments but may be practiced in various forms as below.

(1) In the first embodiment, the bag-like object 32 of the layered body 31 is made of net formed in a bag shape and has a lot of communication holes 32*a* for communicating the inside and the outside of the bag-like object 32. However, the bag-like object 32 does not need to be configured as such but only needs to have communication holes 32*a* for communicating the inside and the outside of the bag-like object 32 at least in upper and lower surfaces of the bag-like object 32. The same is also applicable to the bag-like object 34 constituting the layered body 33. Such a configuration can also achieve the same operation and effects as the first embodiment.

(2) Also, while the bag-like object 32 of the layered body 31 is made of net formed in a bag shape and has a lot of communication holes 32*a* for communicating the inside and the outside of the bag-like object 32 in the first embodiment, the bag-like object 32 does not need to be configured as such but may have any other configuration, such as a grid or mesh configuration, as long as having a lot of holes for communicating both surfaces of the bag-like object 32. The same is also applicable to the bag-like object 34 constituting the layered body 33. Such a configuration can also achieve the same operation and effects as the first embodiment.

(3) Further, the bag-like object 32 of the layered body 31 is made of net formed in a bag shape and has a lot of communication holes 32*a* for communicating the inside and the outside of the bag-like object 32, that is, a plurality of communication holes 32*a* are evenly arranged in the bag-like object 32 in the first embodiment. However, the bag-like object 32 does not need to be configured as such, and may have a plurality of communication holes 32*a* unevenly arranged in the bag-like object 32 as long as the communication holes 32*a* are arranged so as to oppose any of the communication holes 32*a* in vertically adjacent bag-like objects 32 and allow insertion of the steel reinforcing bar 35 therethrough. The same is also applicable to the bag-like object 34 constituting the layered body 33. Such a configuration can also achieve the same operation and effects as the first embodiment.

What is claimed is:

1. A ballast retaining structure used for a bedded track provided with a track bed formed by laying ballast on a roadbed, performing tamping to form a bed-like structure having a predetermined cross-sectional shape such as a trapezoid, and extending the bed-like structure in an extending direction of the roadbed; a plurality of sleepers disposed on the track bed such that longitudinal directions of the sleepers are perpendicular to an extending direction of the track bed; and a pair of rails fastened to upper surfaces of the plurality of sleepers along the extending direction of the track bed, the ballast retaining structure being provided on both sides in a transverse direction of the track bed and along the extending direction of the track bed to thereby retain the track bed from the both sides in the transverse direction thereof, the ballast retaining structure comprising:

a first layered body constituted by a plurality of bag-like objects, each being formed in a bag shape and containing the ballast, stacked from a toe of slope to a top of slope of the track bed and extended in the extending direction of the roadbed, wherein the bag-like object has communication holes for communicating an inside and an outside of the bag-like object formed in at least upper and lower surfaces of the bag-like object;

wherein one of the communication holes formed in the upper or lower surface of the bag-like object is arranged so as to oppose one of communication holes of a bag-like object adjacent to the bag-like object;

wherein the ballast retaining structure includes a first connection member which has a bar-like shape, is passed through mutually opposing communication holes among the communication holes of the plurality of bag-like objects to be located inside the first layered body with a leading end of the first connection member being buried into the roadbed, and thereby connects with each other the plurality of bag-like objects constituting the first layered body; and wherein the first connection member includes an upper lock portion to downwardly press an upper surface of the first layered body, the upper lock portion being provided in a vicinity of an upper end of the first connection member.

2. The ballast retaining structure according to claim 1, wherein the bag-like object has a plurality of the communication holes formed in at least upper and lower surfaces of the bag-like object.

3. The ballast retaining structure according to claim 1, wherein at least upper and lower surfaces of the bag-like object have net-like configurations.

4. The ballast retaining structure according to claim 1, wherein at least upper and lower surfaces of the bag-like object are made of net.

5. The ballast retaining structure according to claim 1, wherein the first connection member includes a lower lock portion to upwardly press a lower surface of the first layered body, the lower lock portion being provided in a vicinity of a lower end of the first connection member.

6. The ballast retaining structure according to claim 1, further comprising a second layered body constituted by bag-like objects, each being formed in a bag shape and containing ballast, placed between the first layered body and the sleepers and extended in the extending direction of the roadbed, wherein the bag-like object has communication holes for communicating an inside and an outside of the bag-like object formed in at least upper and lower surfaces of the bag-like object.

7. The ballast retaining structure according to claim 6, wherein the second layered body is disposed so as to contact both of the first layered body and the sleepers.

8. The ballast retaining structure according to claim 6, wherein the bag-like object constituting the second layered body has a plurality of the communication holes formed in at least upper and lower surfaces of the bag-like object.

9. The ballast retaining structure according to claim 6, wherein at least upper and lower surfaces of the bag-like object constituting the second layered body have net-like configurations.

10. The ballast retaining structure according to claim 6, wherein at least upper and lower surfaces of the bag-like object constituting the second layered body are made of net.

11. The ballast retaining structure according to claim 6, wherein the second layered body is constituted by a plurality of the bag-like objects, respectively containing ballast, placed between the first layered body and the sleepers and extended in the extending direction of the roadbed, wherein one of the communication holes formed in the upper or lower surface of the bag-like object constituting the second layered body is arranged so as to oppose one of the communication holes formed in the upper or lower surface of a bag-like object adjacent to the bag-like object, and wherein the ballast retaining structure includes a second connection member which has a bar-like shape, is passed through mutually opposing communication holes among the communication holes of the plurality of bag-like objects to be located inside the second layered body with a leading end of the second connection member being buried into the roadbed, and thereby connects with each other the plurality of bag-like objects constituting the second layered body.

12. A bedded track comprising:

a track bed formed by laying ballast on a roadbed, performing tamping to form a bed-like structure having a predetermined cross-sectional shape such as a trapezoid, and extending the bed-like structure in an extending direction of the roadbed;

a plurality of sleepers disposed on the track bed such that longitudinal directions of the sleepers are perpendicular to an extending direction of the track bed; and a pair of rails fastened to upper surfaces of the plurality of sleepers along the extending direction of the track bed, and a ballast retaining structure provided on both sides in a transverse direction of the track bed and along the extending direction of the track bed to thereby retain the track bed from the both sides in the transverse direction thereof, the ballast retaining structure comprising a first layered body constituted by a plurality of bag-like objects, each being formed in a bag shape and containing the ballast, stacked from a toe of slope to a top of slope of the track bed and extended in the extending direction of the roadbed, wherein the bag-like object has communication holes for communicating an inside and an outside of the bag-like object formed in at least upper and lower surfaces of the bag-like object;

wherein one of the communication holes formed in the upper or lower surface of the bag-like object is arranged so as to oppose one of communication holes of a bag-like object adjacent to the bag-like object;

wherein the ballast retaining structure includes a first connection member which has a bar-like shape, is passed through mutually opposing communication holes among the communication holes of the plurality of bag-like objects to be located inside the first layered body with a leading end of the first connection member being buried into the roadbed, and thereby connects with each other the plurality of bag-like objects constituting the first layered body; and wherein the first connection member includes an upper lock portion to downwardly press an upper surface of the first layered body, the upper lock portion being provided in a vicinity of an upper end of the first connection member.

* * * * *

UNITED STATES PATENT AND TRADEMARK OFFICE

CERTIFICATE OF CORRECTION

PATENT NO. : 8,240,580 B2
APPLICATION NO. : 12/597638
DATED : August 14, 2012
INVENTOR(S) : Masaki Seki et al.

It is certified that error appears in the above-identified patent and that said Letters Patent is hereby corrected as shown below:

On the Title Page:
Item (73) Assignee: delete "Central Japan Railroad Company (JP)" and insert -- Central Japan Railway Company (JP) --, therefor.

Signed and Sealed this
Twenty-seventh Day of November, 2012

David J. Kappos

David J. Kappos
*Director of the United States Patent and Trademark Office*